US007493733B2

(12) United States Patent
Kelly

(10) Patent No.: US 7,493,733 B2
(45) Date of Patent: Feb. 24, 2009

(54) ROOF STRUCTURE AND METHOD FOR MAKING THE SAME

(76) Inventor: Thomas L. Kelly, 31 Sands St., Waterbury, CT (US) 06710

( * ) Notice: Subject to any disclaimer, the term of this patent is extended or adjusted under 35 U.S.C. 154(b) by 0 days.

(21) Appl. No.: 10/889,940

(22) Filed: Jul. 13, 2004

(65) Prior Publication Data

US 2006/0010808 A1 Jan. 19, 2006

(51) Int. Cl.
*E04B 7/00* (2006.01)

(52) U.S. Cl. ..... 52/409; 52/309.4; 52/309.8

(58) Field of Classification Search ..... 52/408, 52/409, 410, 407.1, 404.3, 506.01, 506.04, 52/746.11, 746.1, 741.1, 745.06, 404.1, 309.4, 52/309.6, 746.4, 746.06, 411, 309.8; 428/316.6; 156/71, 78, 79; 264/34, 255
See application file for complete search history.

(56) References Cited

U.S. PATENT DOCUMENTS 3,266,206 A * 8/1966 Cosby et al. ..... 52/309.9
3,302,362 A * 2/1967 Lang ..... 52/742.13
3,965,633 A * 6/1976 Carroll ..... 52/309.8
4,063,395 A * 12/1977 Stewart et al. ..... 52/309.5
4,492,064 A * 1/1985 Bynoe ..... 52/309.8
4,500,596 A * 2/1985 Lee ..... 428/317.5
4,658,554 A * 4/1987 Riley et al. ..... 52/309.8
4,996,812 A * 3/1991 Venable ..... 52/408
5,031,374 A * 7/1991 Batch et al. ..... 52/410
5,088,259 A * 2/1992 Myers ..... 52/410
5,165,210 A * 11/1992 Partyka et al. ..... 52/746.11
5,441,583 A * 8/1995 Eaton et al. ..... 156/71
5,784,845 A * 7/1998 Imeokparia et al. ..... 52/408
6,006,482 A * 12/1999 Kelly ..... 52/409
6,092,344 A * 7/2000 Kelly ..... 52/410
6,581,348 B2 * 6/2003 Hunter, Jr. ..... 52/408
6,913,816 B2 * 7/2005 Longcor et al. ..... 428/316.6
7,168,221 B2 * 1/2007 Hunter, Jr. ..... 52/746.11

* cited by examiner

*Primary Examiner*—Brian Glessner
*Assistant Examiner*—Adriana Figueroa
(74) *Attorney, Agent, or Firm*—Cantor Colburn LLP

(57) ABSTRACT

Disclosed herein is a foam material upwardly adjacent and in air sealing contact with a roof deck, an insulation layer upwardly adjacent the foam material, and additional foam material upwardly adjacent the insulation layer.

Further disclosed herein is a method for creating a roof system including air sealing a roof deck with a foam material, adhering insulation material to the foam material, and applying additional foam material upwardly adjacent the insulation layer.

9 Claims, 4 Drawing Sheets

ROOF STRUCTURE AND METHOD FOR MAKING THE SAME

BACKGROUND

Roof structures have been made for millennia ranging from simple lean-to thatched arrangements to more modern buildings having multiple layers of roofing materials, fire barriers, vapor barriers, air retarders, rigid roof insulations, cover boards, slipsheets and waterproofing membranes all designed to work together to keep the elements away from occupants of the building. Roof structures continue to be improved because each of the systems currently available has drawbacks and improvements are therefore desirable. Typical problems with roof structures center around wind uplift resistance and energy efficiency with insulations for heat and cold resistance to maintain internal building temperature as well as time and effort required to install the roof system.

SUMMARY

Disclosed herein is a foam material upwardly adjacent and in air sealing contact with a roof deck, an insulation layer upwardly adjacent the foam material, and additional foam material upwardly adjacent the insulation layer.

Further disclosed herein is a method for creating a roof system including air sealing a roof deck with a foam material, adhering insulation material to the foam material, and applying additional foam material upwardly adjacent the insulation layer.

BRIEF DESCRIPTION OF THE DRAWINGS

Referring now to the drawings wherein like elements are numbered alike in the several Figures.

DETAILED DESCRIPTION

Figure 1:
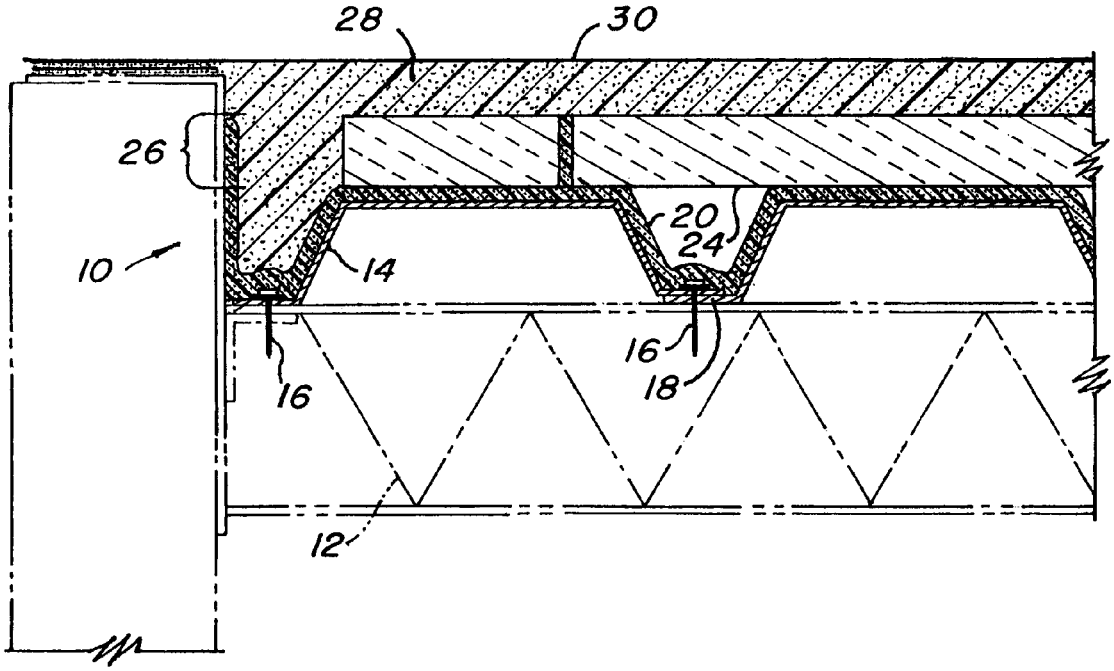
FIG. 1 is a cross-sectional elevation view of the subject roof system.

Referring to FIG. 1 an embodiment of the roof system 10 as disclosed and claimed herein is supported by an underlying building having joists or purlins 12. The roof deck 14 which may be a metal corrugated roof decking material is fastened to the underlying support structure 12 by conventional means such as fasteners 16. As corrugated metal decking 14 or any other modular decking material has a certain size and shape it is clear that there will be joints or overlap sections of the material. In FIG. 1 there is an overlap section identified as an overlap flute area 18. Such overlap flute areas present an opportunity for easy entry of air from the building being roofed if such flutes are not sealed. Abutting edges of plywood or other material roofs create the same problem and can be resolved in the same manner as discussed hereunder.

In the embodiment of FIG. 1, the roof decking material 14 is thinly but relatively uniformly covered by a foam 20 which may be a polyurethane foam or polyurea compound or other material having similar properties and combinations of materials including at least one of the foregoing materials and may be a slow curing foam or a fast curing foam depending upon functionality desired by the installer. As illustrated in FIG. 1, foam 20 is a slow rise, slow cure polyurethane type foam which is desirable in this case because it allows adherence of the insulation board 24 to the uncured newly sprayed foam 20. During application of the foam 20 an installer will, in accordance with this disclosure, pay particular attention to covering overlap flutes 18 and any fastener 16 or other penetrations through the roof deck 14. The purpose of such concentration is to ensure that deck 14 is sealed against air movement therethrough. Following application of the foam 20, a plurality of insulation boards 24 are applied to the uncured foam 20 to be adhered thereto without the use of any mechanical fasteners which might otherwise provide a thermal bridge through the insulation layer. Also notable is that this disclosure teaches one of ordinary skill in the art to place in the insulation layer 24 spaced from a through roof penetration or roof perimeter location creating a space 26 that will subsequently be filled with foam to create a positive air seal and the thickness of the foam also acting as insulation. Following the application of the insulation layer 24 another layer of foam 28 is applied over the insulation layer and around the insulation layer at penetrations or a roof perimeter location. This material may be fast or slow rise material but in general fast rise material will be utilized at this stage of the roof construction since it cures rapidly and allows workers to walk thereon very quickly. Since there is no need to adhere any roof components to this foam material prior to the curing of material 28 there is no need to use slow rise foam. In general about an inch of foam is applied above the insulation boards 24 to provide a uniform top surface having a horizontal or inclined property as desired.

At this point in the creation of the roof system, this roof will be waterproof and may act as a temporary roofing system prior to insulation of the waterproofing membrane which will be the permanent roof waterproofing component. This is beneficial in that workers may utilize the roof for walking without damaging the relatively fragile waterproofing membrane that will be installed later. One example of a membrane is EPDM. The membrane may be installed over the foam 28 in any of a number of conventional methods. The membrane is identified in FIG. 1 as numeral 30.

Figure 2:
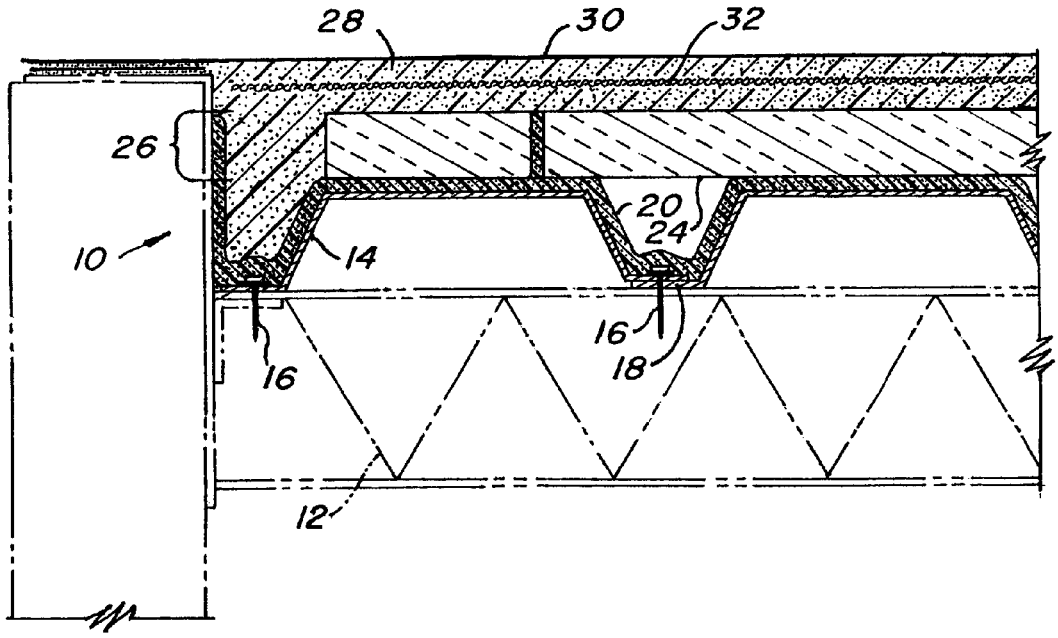
FIG. 2 is a cross-sectional elevation view of the similar roof system to that of FIG. 1 however including a reinforcing mesh in a first position.

Referring now to FIG. 2, it will be appreciated by one of ordinary skill in the art that the roof of FIG. 2 very similar to that of FIG. 1; the distinction between the two figures is that an additional reinforcing layer 32 is embedded about halfway between insulation layer 24 and the ultimate top surface of material 28. In one embodiment the reinforcing material 32 is installed in this location by applying less foam 28 over the insulation board 24 such as for example about a half inch of spray foam locating reinforcement material 32 openly adjacent to a half inch sprayed foam and then spraying an additional half inch of foam thereover. It will be understood that the thicknesses of foam indicated herein are only intended for relative purposes and are not intended to be limiting with respect to how thick or how thin the foam is ultimately applied.

Figure 3:
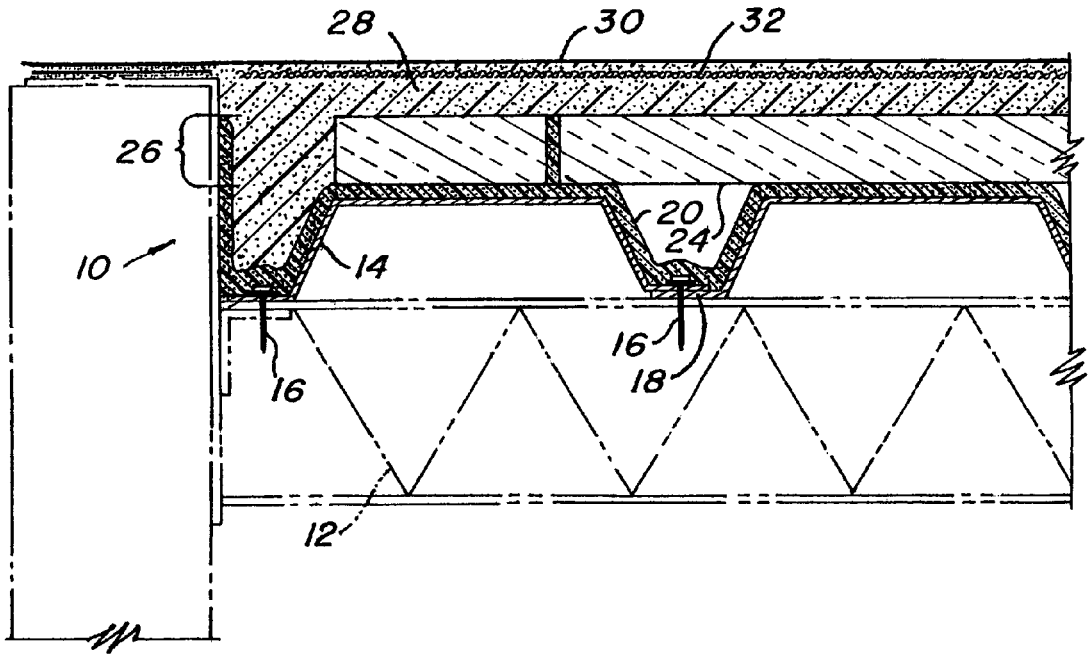
FIG. 3 is a cross-sectional elevation view of another alternate embodiment roof system with the reinforcing mesh in a second position.

The reinforcing material 32 is in one embodiment a mesh material which may comprise fiberglass, nylon, polyester, or other material having similar properties with respect to the purpose for which the reinforcing material 32 is added to the roof system of FIG. 2. That is that the material will add tensile strength, rigidity, transverse strength, etc. to the roof system. The reinforcement, if fiberglass, adds fire protection for polystyrene rigid roof insulations from exterior fire sources. Referring now to FIG. 3 one of ordinary skill in the art will again recognize that much of the figure is similar to the foregoing figures with places the reinforcing material 32 very near or at the top surface of foam 28. The reinforcing material may be installed in this position by locating material 32 at the top surface of foam 28 prior to curing thereof and may then be sprayed over or urged into foam 28. It is noted that in some applications it may be desirable to utilize slow rising foam in place of faster rising foam 28 for purposes of increasing adherence between the foam layer and the reinforcing material 32. With respect to both FIGS. 2 and 3 the waterproofing membrane 30 is installed as was indicated with respect to FIG. 1.

Figure 4:
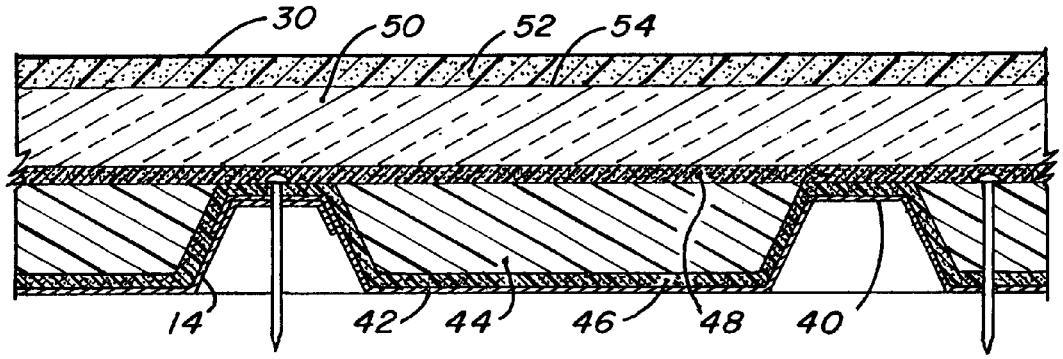
FIG. 4 is a cross-sectional elevation view of a roof system intended for a metal building.

Referring now to FIG. 4 this roofing system could be applied to an existing metal building that did not employ an insulated type roofing system when originally manufactured or built but rather simply utilized the metal deck 14 as the roof system. This disclosed roofing system could also be utilized on a new metal building the builder of which desires a better roofing system initially. It is worth pointing out that metal decking which is utilized for metal buildings is generally configured with the high flute 40 being narrow and the low flute 42 being relatively wide which in the industry tends to be 12 to 16 inches in width. Because of the wide low flute it is desirable when installing a roof system thereon to utilize expanded polystyrene flute fillers 44 to effectively level the roof surface prior to installing upwardly adjacent layers. In this embodiment fillers 44 are effectively glued in place by slow rise foam 46 which has been sprayed over the deck 14 relatively uniformly in all locations but, of course, in accordance with the former teachings of this application, with particular attention paid to penetrations of the roof deck in order to prevent air leakage therethrough. Slow rise foam 46 is utilized in this regard in order to provide time for roof installers to position flute filler 44 prior to curing of material 46. Subsequent to the installation of the flute filler 44 a relatively uniform coating of slow rise material 48 is sprayed over the entirety of the roof and insulation 50, generally in board form, is set into slow rise material 48 prior to curing thereof in order to adhere the insulation 50 to the underlying roof component removing the need for metal fasteners for insulation 50 which would otherwise create thermal bridges through that insulation as has been evident in prior art roof structures.

Since it is well known in the art tat insulation 50, particularly if it is polystyrene or polyisocyanurate insulation cannot be left open to the elements therefore spray foam layer 52 is applied to the top surface 54 of insulation 50 to seal and protect the same. In one embodiment foam 52 would be about an inch thick. As in the foregoing embodiments the temporary roof structure is created without membrane 30 but membrane 30 will desirably be installed upwardly adjacent the foam layer 52 when work on the building is completed.

Figure 5:
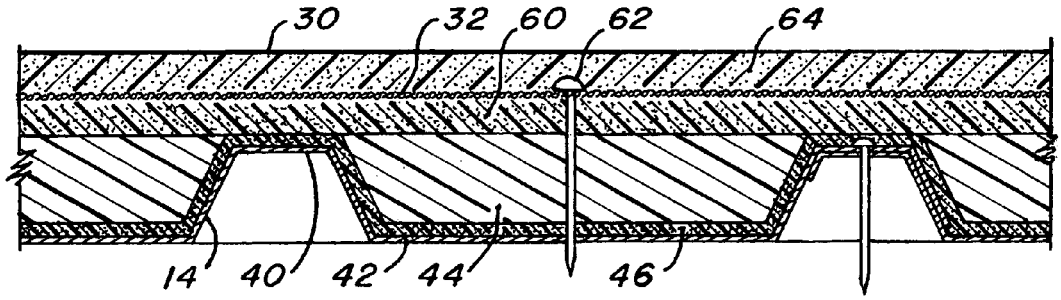
FIG. 5 is a cross-sectional elevation view of a roof system similar to that of FIG. 4 and the reinforcing material applied thereto.

Referring now to FIG. 5, one of ordinary skill in the art will recognize some of the components of this figure are similar to those of FIG. 4 and therefore are numbered similarly in this embodiment. No insulation layer 50 is utilized but rather thicker sections of foam are utilized instead. In addition, a reinforcing layer 32 is installed. One method of installing this roof system starts as does the FIG. 4 embodiment with slow rise foam 46 adhering flute fillers 44 to low flutes 42 of the deck 14. Immediately upwardly adjacent flute fillers 44, a layer of foam 60 is applied which is, in one embodiment, about a half inch thick or thicker. It is again to be understood that this measurement is for exemplary and comparative purposes rather than for limiting purposes. More or less spray foam could be used at will. Reinforcing material 32, which may be a mesh material such asa fiberglass, nylon, polyester or other similar property mesh as was the case in the foregoing embodiments, is positioned upwardly adjacent foam layer 60. In the event that foam layer 60 utilizes slow rise foam, reinforcing material 32 is likely to be adhered to that foam. Tn the event that a fast rising/fast curing foam layer 60 is utilized it is possible that the reinforcing layer 32 may not adhere to layer 60. Reinforcing layer 32 is mechanically fastened by fastener 62 through foam layer 60, through flute filler 44 and through deck 14 to mechanically attach the roof system to the deck. While a mechanical fastener is utilized herein which raises concern about thermal bridging effects, it is noted that the fastener does not bridge all the way to the top surface of the roofing system and therefore the thermal bridging effects of the prior art are lessened or nullified in this embodiment. Subsequent to mechanically attaching the reinforcing material 32 to the roof deck an additional layer of foam material 64 is applied to a top surface of the mesh 32. This may be of any thickness but in one embodiment will be about a half inch. As in the foregoing embodiments, once cured layer 64 the roof is temporarily water sealed and building construction activity across and thereon is permissible. Once work is done with respect to the building, the roofing membrane 30 is installed upwardly adjacent the top surface of foam layer 64 in a conventional way such as loose laid, fully adhered, mechanically attached, etc.

Each of the embodiments described hereinabove have substantial benefit with respect to the roofing industry. The first benefit is that the foam material utilized substantially enhances structural integrity of the roofing system. The second benefit is that for the metal-deck type systems the dew point on the building side surface of the metal deck has substantially changed such that condensation does not form and rust is substantially reduced. The third benefit is that a temporary roof is created which is rapid and relatively easy to install, prevents damage to underlying roof components and allows work to continue on the building without risk of damaging a roof waterproofing membrane. The fourth benefit is a substantially increased R-value of the roof system due to enhanced insulated properties of the foam material and due to the lack of thermal bridges existing within the structure.

While preferred embodiments of the invention have been shown and described, various modifications and substitutions may be made thereto without departing from the spirit and scope of the invention. Accordingly, it is to be understood that the present invention has been described by way of illustration and not limitation.

What is claimed:

1. A roof system comprising:

a foam material upwardly adjacent and in air sealing contact with a roof deck, said foam material filling a space around a perimeter of the roof system, and said foam material being a rise and cure foam;

an insulation layer disposed upwardly of and in contact with the foam material; and an additional foam material of a different material than said foam material, wherein said additional foam material is disposed upwardly of and in contact with the insulation layer and wherein said additional foam material is disposed in contact with said foam material at said space around said perimeter of the roof system, wherein said additional foam material is a rise and cure foam that rises and cures at a faster rate than said foam material.

2. A roof system as claimed in claim 1 wherein a roof water proofing membrane is disposed upwardly adjacent the additional foam material.

3. A roof system as claimed in claim 1 wherein the reinforcing material is disposed at an additional foam material.

4. A roof system as claimed in claim 3 wherein the reinforcing material is embedded in the additional foam material.

5. A roof system as claimed in claim 1 wherein the additional foam material exists in more than one layer and a reinforcing material is disposed at an interface between adjacent foam layers of the additional foam material.

6. A roof system as claimed in claim 1 wherein a space around a through-roof penetration is substantially filled with foam material.

7. A roof system as claimed in claim 2 wherein the membrane is loose laid.

8. A roof system as claimed in claim 2 wherein the membrane is totally adhered.

9. A roof system as claimed in claim 2 wherein the membrane is mechanically attached.

* * * * *